United States Patent [19]

O'Connell, Sr.

[11] Patent Number: 4,641,666

[45] Date of Patent: Feb. 10, 1987

[54] SMOKE FILTERING MATERIAL

[76] Inventor: Harold O'Connell, Sr., 596 Newtown St., South Hadley, Mass. 01075

[21] Appl. No.: 818,006

[22] Filed: Jan. 13, 1986

[51] Int. Cl.[4] ..... A24D 3/08

[52] U.S. Cl. ..... 131/341; 131/331; 131/342

[58] Field of Search ..... 131/331, 342, 341

*Primary Examiner*—V. Millin

*Attorney, Agent, or Firm*—Fishman & Dionne

[57] ABSTRACT

A smoke filtering material and composition comprises a charcoal type product or a liquid extract used in conjunction with a fibrous filter and made from the flower portion of red-fruited sumac trees. This filtering material provides improved smoke filtering and eliminates or substantially reduces the tar from tobacco and other smoke.

29 Claims, No Drawings

SMOKE FILTERING MATERIAL

BACKGROUND OF THE INVENTION

This invention relates to a smoke filtering composition. More particularly, this invention relates to a new and improved smoke filtering composition derived from the fruit of a red-fruited sumac plant (e.g. staghorn sumac) and which is well suited for removing or extracting the harmful tar from smoke (e.g. tobacco smoke) using filters and filter materials treated with the present invention. The present invention is also suitable for all types of smoking devices including mechanical equipment, breathing devices and tobacco products. Thus, the smoke filtering composition of the present invention may be used in the manufacture of cigarettes, cigars, pipes, mouth pieces and other smoking items or devices; and the filtering systems of various mechanical equipment used for clearing smoking related air within structures; and as filters in a product treated nostril mold or "gas" mask.

Filtering materials and compositions for removing tar and other unhealthy substances from the atmosphere is a continuing source of research and development. The problem of adequately filtering unhealthy components from smoke is particularly acute in the cigarette and other tobacco smoking areas. Several prior art attempts at providing a filtering material specifically aimed at removing tars and other harmful and irritating gaseous compounds from tobacco include U.S. Pat. No. 1,985,840 to Sadtler (proposing the use of willow charcoal); U.S. Pat. No. 2,355,652 to Irvin (disclosing the use of several types of woods); and U.S. Pat. No. 3,279,478 to Silby (describing the use of carob and mangrove tree roots as a filtering material). However, while all of these prior art patents have attempted to provide a tobacco smoking filter composition which removes certain disagreeable and objectionable ingredients from the smoke before the smoke reaches the mouth of the smoker, it is believed that none of these materials perform adequately or have met commercial success.

SUMMARY OF THE INVENTION

The above-described and other problems and disadvantages of the prior art are overcome or alleviated by the smoke filtering material and composition of the present invention. In accordance with the present invention, charcoal type or liquid extract products used in conjunction with a fibrous filter and made from the flower portion of red-fruited sumac trees provides improved smoke filtering and eliminates or substantially reduces the tar from tobacco and other smoke.

The above-discussed and other features and advantages of the present invention will be apparent to and understood by those skilled in the art from the following detailed description.

DESCRIPTION OF THE PREFERRED EMBODIMENT

The smoke filtering material or composition of the present invention is derived from the flower portion of a red-fruited sumac tree. Preferably, the sumac variety used in accordance with the present invention is staghorn sumac. Staghorn sumac, Rhus typhina L., is a member of the cashew family. The ripe, crimson, hairy fruit is borne in dense clusters. There are other red-fruited sumac varieties with differences in size or stem coverings, such as lemonade tree, vinegar tree, scarlet sumac, virginian sumac, velvet sumac, etc. It is believed that these other red-fruited sumac varieties are interchangeable with the staghorn sumac, and that all of the various red-fruited sumac varieties may provide the excellent smoke filtering and tar removing features of the present invention. It will be appreciated that the red-fruited species of the sumac are harmless and pose no health hazard to humans. Information on the edibility differences for human beings and animals is available in standard reference books. The red-fruited species of sumac should not be confused with the white-fruited species of sumac. The berries of the white-fruited sumac are poisonous to human beings and should not be used in conjunction with the smoke filtering composition of the present invention.

The following procedure is preferred in processing the red-fruited sumac and providing the smoke filtering material of the present invention. It will be appreciated that subsequent to processing, both a charcoal-like solid material and a liquid extract will remain. Both of these products (i.e., solid and liquid) provide smoke filtering.

(1) The fruit, entire clusters, are harvested from the red-fruited sumac (staghorn) when ripe. Each cluster is bruised (shelled) to remove the fruit (nutlets) from the clusters. The shells or shucks are reserved for later usage as will be discussed hereinbelow. Thereafter, about one gallon of water (tap water) is added to about one quart of dry shelled fruit. The fruit/water mixture is brought to a brisk bubbling boil. this mixture is then simmered for approximately 30 minutes and removed from the heat. Thereafter, the fruit is removed from the liquid, retaining both the fruit (solids) and the juice (liquids) separately. The separated solids and liquids are then cooled to room temperature.

(2) Solids: The separated solids (fruit) are spread on a flat tray, shaken periodically until perfectly dry. The dried fruit is then placed in a large metal container such as a frying pan. The product is heated (toasted) over low heat, stirring occasionally until it becomes a charcoal-like substance. Thereafter, the heated product is removed from the heat. It will be appreciated that the product can be processed either with the seeds or without. As will be discussed below, this charcoal-like product can be used in the cigarettes or other tobacco items; and may be used in a ground, powdered or other suitable physical state.

(3) Liquid: Once the solids are removed from the juice, the liquid product is ready for use in conjunction with conventional fibrous filtering material.

(4) Shucks: After shucking (shelling), the remaining shucks and loose materials can be processed in the same manner (i.e., cover with water and boiled) as were the fruit. When simmered for 30 minutes, the water/-shucked mixture is removed from the heat. Thereafter the shucks are strained and discarded. At this point, the liquid is cooled and is ready for use in processing filtering material in accordance with the present invention as set forth in (3) above.

It will be appreciated that no chemicals or other additives are needed to process the red-fruited sumac fruit during any of the foregoing operations. This is an especially significant feature of the present invention with regard to cost effectiveness, ease of processing and favorable health risks.

Following the above-described processing of the red-fruited sumac, the liquids and solids are then used to produce filtering materials for tobacco items or in the filtering systems of various mechanical equipment and other devices such as gas masks, etc. With regard to the preparation of cigarettes and other tobacco related items as already mentioned, the solid materials and the liquid materials may be used either alone or in combination.

EXAMPLE I

In the case of a cigarette, in a preferred embodiment, the processed solid sumac product is placed against a conventional fibrous filter, for example, a one half inch filter, dividing the cigarette between the filter and the tobacco smoking material. The cigarette is then completed by using conventional fresh tobacco smoking material and cigarette paper sleeve. It will be appreciated that only single paper sleeve covers solid filtering product to protect tar removal and extinguishing capabilities.

EXAMPLE II

A conventional fibrous filter (preferably three-quarter inch or smaller) is saturated in the liquid product. The saturated filter is then dried and placed against a non-treated filter, dividing the cigarette between the non-treated filter and the smoking tobacco material and cigarette paper sleeve. The cigarette is then completed by using a requisite amount of conventional tobacco smoking material and cigarette paper sleeve. Only single paper sleeve covers product treated filter to protect tar removal and extinguishing capabilities. This procedure may equally be used to provide treated filters which may be adapted for use in mechanical filtering equipment, in nostril molds, or in gas masks to remove the tar from smoky indoor air.

Of course, equipment or other filtering means may be made by combining Examples I and II above and using a liquid product saturated filter with a selected amount of solid product. It will be appreciated that with regard to cigars or pipes, a disposable, product-treated filter formed from the above-described procedure could be added to either the mouth piece (pipe) or a cigar holder.

Actual smoking tests have revealed that the prepared, product-treated cigarettes described above removed all, or substantially all of the tar from cigarettes advertised to contain tar from one mg (the lowest), to seventeen mg (the highest tar content cigarette available for testing).

The testing also included induced smoking by means of pumping a cigarette not containing the sumac product in the manner of a smoker and routing the smoke through a tube into a closed bottle. The residue from the smoke, the sticky tar substance, coated the bottom of the bottle. When the cigarette containing the sumac processed product of the present invention was tested in the same manner, the smoke in the bottle did not leave any sticky tar residue. The smoke filtering composition of the present invention blocked the tar from the smoke traveling through the cigarette. The perfectly white conventional non-treated manufacturers' filters remained substantially white instead of the brown color that now stains filters during smoking, tending to show that the tar had been removed.

Significantly, the testing results included the comment of the chain-smoker tester that the added product did not change the taste of the cigarette to any degree.

A filter of a soft, absorbent material, or a wafer, treated with the product, can be used in an electric or battery operated fan, or in a ventilator in a room using pressure or suction to draw the smoke through the filter to remove the tar. The treated filters or wafers are processed in the same manner as the saturated filters that are added to cigarettes. This removes the tar from the smoky air in the room from cigarettes burning between puffs and emitting untreated smoke directly into the air.

Using the product or the treated filter of the present invention to remove the tar in cigarettes has the following benefits.

(1) The affects of the smoke from product-treated cigarettes entering the smoker's mouth, "pipes", and lungs are much less harmful to the individual.

(2) The affects of the exhaled lung smoke without the tar would be much less harmful to the individual as it passes through the "pipes" and nasal passages.

(3) The affects of exhaling smoke that is free from tar and possibly other substances into the room would allow all present therein (smokers and non-smokers) to breathe cleaner air, thus it is much less harmful.

(4) Another major feature and advantage in using the present invention is that when the burning (lit) end of the fresh cigarette reaches the sumac charcoal-like product or the fibrous filter saturated with liquid product, the cigarette immediately extinguishes. It is believed that the combination of heat and moisture from the smoked cigarette causes the product to become saturated by the sticky tar and this extinguishes the cigarette at the point where the product is reached by the burning tobacco. It should also be possible to clip off a portion of the cigarette for just a few puffs before retiring or entering a non-smoking area, to insure that the cigarette will extinguish almost immediately because of the added product.

While not presently known, it is believed that the treated cigarettes in accordance with the present invention may have additional extracting qualities that remove other harmful substances, gases, etc., such as nicotine, carbon monoxide, etc., that could cause additional harmful smoking side affects.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method of making a smoke filtering composition comprised of the flower portion of a red-fruited sumac tree which has been processed in accordance with the steps comprising:

separating the sumac fruit from the sumac cluster;
boiling the fruit in a liquid; and
separating the boiled fruit from the liquid.

2. The method of claim 1 including:

drying the fruit; and
heating the fruit whereby it becomes a charcoal-like substance.

3. The method of making a smoke filtering composition of claim 2 including:

combining said charcoal-like sumac fruit with fibrous filter material.

4. The method of claim 1 including:

saturating fibrous filter material with the boiled liquid; and
drying the saturated filter.

5. The method of claim 3 including:

combining the charcoal-like fruit/fibrous filter with tobacco smoking material.

6. The method of claim 4 including:

combining the saturated and dried fibrous filter with tobacco smoking material.

7. The method of claim 6 including:

placing the saturated, dry filter against a nontreated filter.

8. The method of claim 7 including:

placing the smoking tobacco material so that treated filter separates the non-treated filter from the tobacco; and completing the cigarette with a conventional cigarette covering.

9. The method of claim 1 wherein the sumac tree includes shucks, leaves, branches, cluster and the like and including the steps of:

boiling the sumac clusters, shucks, leaves and branches in a liquid; and separating the boiled shell liquid from the shell.

10. The method of claim 9 including:

combining the boiled shell liquid with fibrous filter material.

11. The method of claim 1 wherein the red-fruited sumac is selected from the red-fruited sumac varieties comprising staghorn sumac, lemonade tree, vinegar tree, scarlet sumac, virginian sumac and velvet sumac.

12. A smoke filtering composition comprised of the flower portion of a red-fruited sumac tree which has been processed in accordance with the steps comprising:

separating the sumac fruit from the sumac cluster;

boiling the fruit in a liquid;

separating the boiled fruit from the liquid;

drying the fruit;

heating the fruit whereby it becomes a charcoal-like substance; and combining said charcoal-like sumac fruit with fibrous filter material.

13. The composition of claim 12 including:

saturating said fibrous filter material with the boiled liquid; and drying the saturated filter.

14. The composition of claim 12 including:

combining the charcoal-like fruit/fibrous filter with tobacco smoking material.

15. The composition of claim 13 including:

combining the saturated and dried fibrous filter with tobacco smoking material.

16. The composition of claim 15 including:

placing the saturated, dry filter against a nontreated filter.

17. The composition of claim 16 including:

placing the smoking tobacco material so that treated filter separates the non-treated filter from the tobacco; and completing the cigarette with a conventional cigarette covering.

18. The composition of claim 12 wherein the sumac tree includes shucks, leaves, branches, cluster and the like and including the steps of:

boiling the sumac clusters, shucks, leaves and branches in a liquid; and separating the boiled shell liquid from the shell.

19. The composition of claim 18 including:

combining the boiled shell liquid with fibrous filter material.

20. The composition of claim 12 wherein the red-fruited sumac is selected from the red-fruited sumac varieties comprising staghorn sumac, lemonade tree, vinegar tree, scarlet sumac, virginian sumac and velvet sumac.

21. A smoke filtering composition comprised of the flower portion of a red-fruited sumac tree which has been processed in accordance with the steps comprising:

separating the sumac fruit from the sumac cluster;

boiling the fruit in a liquid;

separating the boiled fruit from the liquid;

saturating fibrous filter material with the boiled liquid; and drying the saturated filter.

22. The composition of claim 21 including:

drying the fruit; and heating the fruit whereby it becomes a charcoal-like substance;

combining said charcoal-like sumac fruit with said fibrous filter material.

23. The composition of claim 22 including:

combining the charcoal-like fruit/fibrous filter with tobacco smoking material.

24. The composition of claim 21 including:

combining the saturated and dried fibrous filter with tobacco smoking material.

25. The composition of claim 24 including:

placing the saturated, dry filter against a nontreated filter.

26. The composition of claim 25 including:

placing the smoking tobacco material so that treated filter separates the nontreated filter from the tobacco; and completing the cigarette with a conventional cigarette covering.

27. The composition of claim 23 wherein the sumac tree includes shucks, leaves, branches, cluster and the like and including the steps of:

boiling the sumac clusters, shucks, leaves and branches in a liquid; and separating the boiled shell liquid from the shell.

28. The composition of claim 27 including:

combining the boiled shell liquid with fibrous filter material.

29. The composition of claim 23 wherein the red-fruited sumac is selected from the red-fruited sumac varieties comprising staghorn sumac, lemonade tree, vinegar tree, scarlet sumac, virginian sumac and velvet sumac.

* * * * *